United States Patent [19]

Ondricek

[11] 4,423,563

[45] Jan. 3, 1984

[54] FOLDING PICTURE FRAME

[76] Inventor: George Ondricek, 150 NW. 126th St., North Miami, Fla. 33168

[21] Appl. No.: 431,339

[22] Filed: Sep. 30, 1982

[51] Int. Cl.[3] ..... G09F 19/00

[52] U.S. Cl. ..... 40/533; 40/152; 40/152.1

[58] Field of Search ..... 40/152, 152.1, 154, 40/530, 533; 281/15 R, 38

[56] References Cited

U.S. PATENT DOCUMENTS

| | | | |
|---|---|---|---|
| 185,139 | 12/1876 | Schneider | 40/533 |
| 716,074 | 12/1902 | Magie | 40/152.1 |
| 786,271 | 4/1905 | Desmarais | 40/533 |
| 857,391 | 6/1907 | Goldberg | 40/533 |
| 1,326,832 | 12/1919 | Baily | 40/533 |
| 1,691,049 | 11/1928 | Douglas | 40/530 |
| 2,086,443 | 7/1937 | Rutyna | 40/152.1 |
| 3,286,382 | 11/1966 | Newman | 40/533 |
| 4,226,037 | 10/1980 | Rodriguez | 40/152.1 |

*Primary Examiner*—Gene Mancene
*Assistant Examiner*—Wenceslao J. Contreras
*Attorney, Agent, or Firm*—Ernest H. Schmidt

[57] ABSTRACT

A folding picture frame comprising a rectangular housing and a rectangular front picture panel hinged along one side of the housing and normally folded against the housing in face-to-face relation unfolds to one side to reveal a second picture of approximately twice the size of the front panel picture and expose a plurality of selectively displayable pictures concealed within the picture frame and unfoldable by hinge means in the direction of the unfolded front picture panel. The front picture panel hinge and the concealed picture hinge means are such that each of the selected interior pictures, when unfolded for display, lies in a substantially flat plane.

3 Claims, 9 Drawing Figures

21
10
23
11
19

25
24
21
11
23
19

6
21
12
23
20
13c
13b
13a
6

22
7
12
29
15b 23
8
12
13
27
18
15c
14
17b
15a
16
31
17c
14
7
15
29
17a 8
17

20
12
11
24
23
19
25

20
18
13b
22
30
27
13c
11
13a
13

20
33a
18
15b
22
30
33
30a
28
15c
13c
27a
19
27
15a
14
13a
13

20
18
33a
17b
22
33
30a
28
19
13c
27
30
17a
13
14
16

23
19

FOLDING PICTURE FRAME

This invention relates to picture frames and is directed particularly to a picture frame which, when folded together, presents the appearance of a single frame of a given size displaying a picture, chart or the like at the front, but which when unfolded, exposes a plurality of maps, pictures, graphs, charts or the like which can be selectively unfolded for vertical display in a size approximately double the size of the folded together frame.

The principal object of this invention is to provide a folding picture frame for home or office use which, in its folded condition, can be hung against a small wall area while at the same time being capable of displaying, selectively, a plurality of relatively large, normally concealed maps, pictures, graphs, charts or the like when unfolded. When unfolded, the picture frame can extend into an open area, such as a doorway opening, or over another picture on the wall, to provide additional space for display of the relatively large, selectively viewable, normally concealed maps, pictures or charts.

Another object of the invention is to provide a folding picture frame of the character described including hinge mechanism for swingingly unfolding the front picture or chart and the selective interior pictures or charts in such a manner that each interior chart selected for display will be unfolded into a common plane for substantially flat presentation.

A more particular object of the invention is to provide a folding picture frame of the above nature comprising a rectangular picture frame housing and a front panel vertically hinged to the housing along one side thereof to permit unfolding from a position overlying the frame housing to a position extending laterally outwardly of one side of the housing, the hinge mechanism further being operative, when the front panel is so outwardly unfolded, to reposition the front panel rearwardly of the front face of the picture frame housing so that its inner surface will lie in substantially the same plane.

Another object is to provide a folding picture frame of the above nature which, when in its folded condition, the front panel can serve as a decorative picture in the home or office for esthetic purposes, while at the same time concealing maps, charts, graphs, and the like for utilitarian purposes, as may be required or desired from time to time.

Other objects, features and advantages of the invention will be apparent from the following description when read with reference to the accompanying drawings.

BRIEF DESCRIPTION OF THE DRAWINGS

In the drawings, wherein like reference numerals denote corresponding parts throughout the several views.

DETAILED DESCRIPTION OF THE INVENTION

Figures 1, 2, 3, 4, 9:
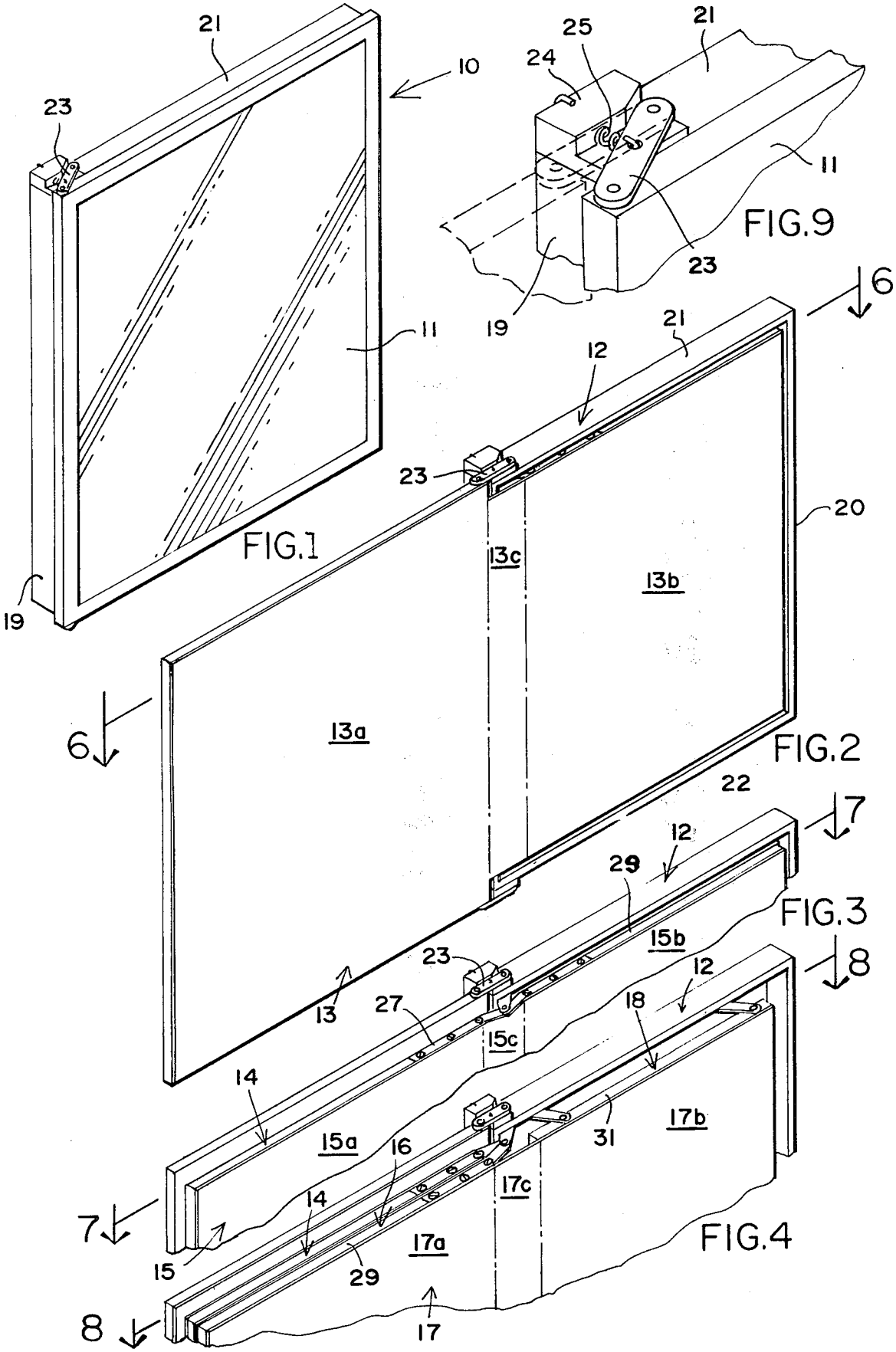
FIG. 1 is an oblique view, as seen from the front, of a folding picture frame embodying the invention.
FIG. 2 is an oblique view, similar to that of FIG. 1, but showing the picture frame unfolded to its second position of use.
FIG. 3 is a partial oblique view, similar to that of FIG. 2, but illustrating the picture frame further unfolded to its third position of use.
FIG. 4 is a partial oblique view illustrating the picture frame in its fourth position of use.
FIG. 9 is a partial, oblique view of the picture frame upper hinge mechanism, illustrating mechanical details thereof.

Referring now in detail to the drawings, reference numeral 10 in FIG. 1 designates, generally, a preferred form of folding picture frame embodying the invention, shown in fully collapsed or folded condition. In such folded condition it displays a front panel 11, which may comprise a mirror, oil painting or other art-work, photograph, map, chart or the like, in accordance to the use to be made of the folding picture frame.

FIG. 2 illustrates how the front panel 11 can be swung outwardly or unfolded to one side of the housing 12 of the picture frame to expose a display panel 13, flat in a common plane, approximately twice the size of the front panel 11. The display panel 13 could be any flat graphic representation desired to be displayed, and comprises a left-hand panel portion 13*a*, a right-hand panel portion 13*b* and a central panel portion 13*c*, the central portion being of a flexible sheet material or fabric allowing for folding and unfolding in the manner hereinafter more particularly described.

FIG. 3 illustrates how a first interior panel carrier 14 can next be swung outwardly of the housing of the picture frame 12 to unfold for selective use a second display panel 15. The second display panel 15 comprises left and right-hand panel portions 15*a* and 15*b*, respectively, and central, flexible panel portion 15*c* permitting folding and unfolding.

FIG. 4 illustrates how a second interior panel carrier 16 can next be swung outwardly of the picture frame housing for selective use of a third display panel 17. The third display panel 17 also comprises left and right-hand panel portions 17*a* and 17*b*, respectively, and a central, flexible panel portions 17*c* permitting folding and unfolding. The right-hand panel portion 17*b* is supported by a panel carrier 18 having a parallel guide mechanism attached to the interior of the picture frame housing 12 at one side to permit forward movement of said panel carrier so that all portions of the third display panel 17, when unfolded, will lie in an approximately common plane.

Figures 5, 6, 7, 8, 10:
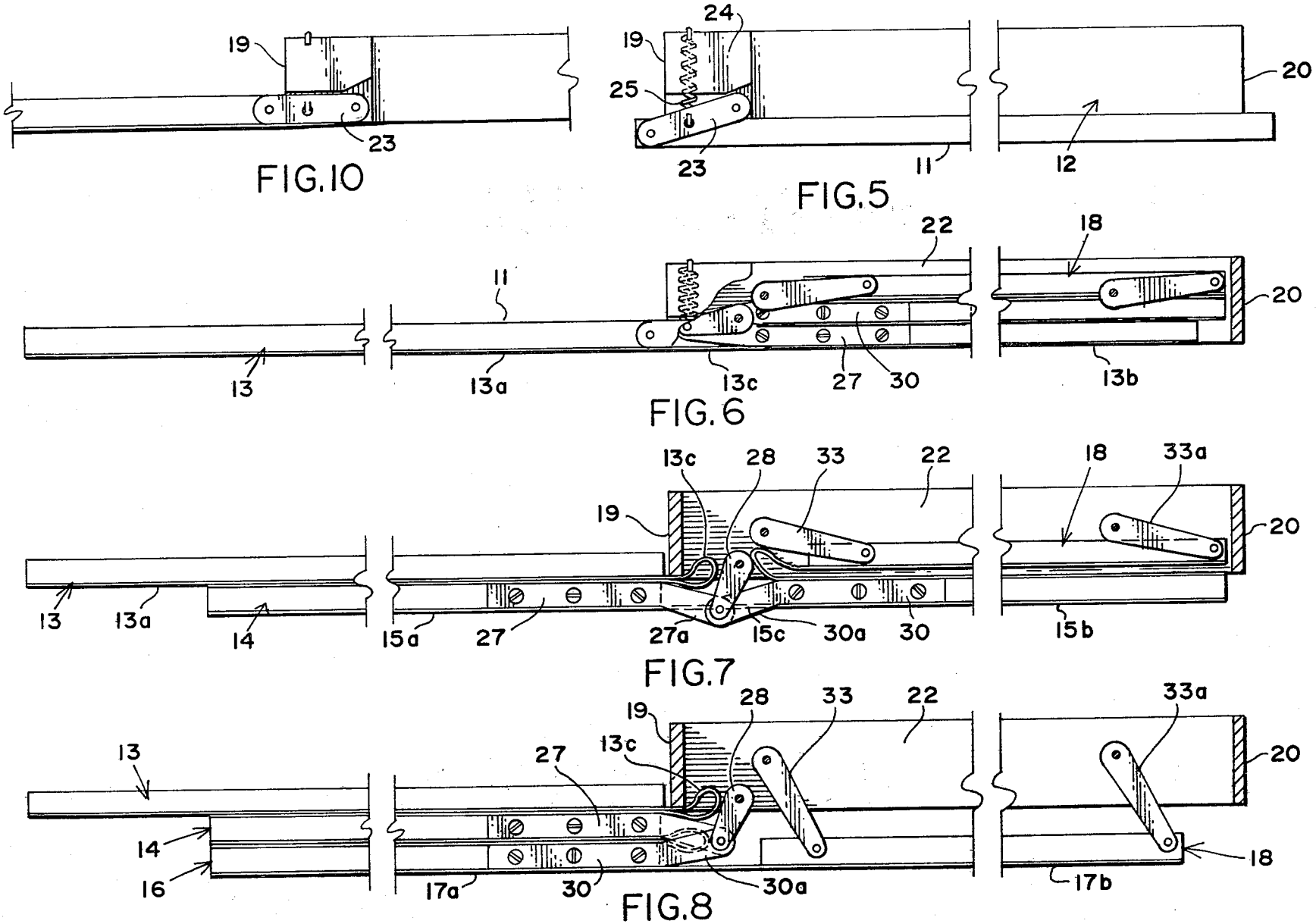
FIG. 5 is a top view of the folded together folding picture frame illustrated in FIG. 1.
FIG. 6 is a cross-sectional view of the picture frame taken along the plane indicated at 6—6 of FIG. 2 in the direction of the arrows.
FIG. 7 is a horizontal cross-sectional view, taken along the plane indicated at 7—7 of FIG. 3 in the direction of the arrows.
FIG. 8 is a horizontal cross-sectional view of the picture frame as illustrated in FIG. 4, taken along the plane indicated at 8—8 thereof in the direction of the arrows.

As illustrated in FIGS. 1, 2, and 8, for example, the picture frame housing 12 comprises parallel side rails 19 and 20 interjoined with top and bottom members 21 and 22, respectively. The front panel 11, which comprises a rectangular frame, preferably being of slightly larger size than the picture frame housing 12, is hinged by means of elongated hinge links 23 to the top and bottom at one side of said picture frame housing (only the upper hinge link 23 being visible on the drawings). As is best illustrated in FIG. 9, the outer end of the upper hinge link 23 is pivotally journaled to a recessed hinge block 24 fixed to the upper end at one side of the top picture frame housing member 21. The pivotal axes of the hinge link 23, with respect to the picture frame housing, the front panel framework and the length of said hinge link, are such that when the front panel 11 is swung outwardly to the display position of FIG. 6 (see also FIG. 9) the surface defined by the left-hand portion 13*a* of the display panel 13 will lie in substantially the same plane as that of the front of the picture frame housing 12. A tension spring 25 interconnecting a central portion of the hinge link 23 with the hinge block 24 (see FIG. 9), serves to resiliently urge the front panel 11, when fully unfolded or opened, to the position illustrated by the brokenline representation thereof in FIG. 9, wherein the front surfaces of the exposed inside of the frame of the front panel 11 and the front of the picture frame housing 12 lie in the same plane.

As illustrated in FIG. 2, the first interior panel carrier 14, which comprises a rectangular frame or support member 26, is hinged with respect to the inside of the picture frame housing 12 with use of hinge bars 27 secured along opposed, upper and lower edge portions of said support member (only the upper hinge bar 27 is illustrated in the drawings). The hinge bars 27 have anguarly-outwardly-extending portions 27*a* which are pivotaly joined at their outer ends to the outer ends of pivotal links 28 the inner ends of which, as is best illustrated in FIGS. 3 and 7, are secured to respective top and bottom members 21, 22 of the picture frame housing 12. As illustrated in FIGS. 3 and 7, this hinge mechanism permits the first interior panel carrier 14 to be unfolded from its position as illustrated in FIGS. 2 and 6 to the position of FIGS. 3 and 7, flat against the left-hand panel portion 13*a* of the display panel 13, while at the same time presenting the left-hand panel portion 15*a* of display panel 15 to lie in substantially the same plane as that of right-hand panel portion 15*b* thereof. To accomplish this, the second interior panel carrier 16, which comprises a rectangular frame or support member 29, is fitted at opposed, upper and lower edge portions, with hinge bars 30 having angularly-offset, outwardly-extending portions 30*a* which are also pivotally joined with the upper and lower pivotal links 28. As illustrated in FIGS. 3, 4, 7, and 8, the lengths of the angularly-outwardly-extending portions of the hinge bars 27*a* and 30*a* hinging the first and second interior panel carriers 14, 16, respectively, and their mutual angular directions, are such that said carriers, when unfolded to exhibit the second display panel 15, support said panel in a substantially flat plane. When further unfolded by swinging the second interior panel carrier 16 from left to right as illustrated in FIGS. 4 and 8, they will be brought into face-to-face abutting engagement at the left-hand side of the assemblage to expose the third display panel 17, the right-hand panel portion 17*b* of which is supported by the third panel carrier 18 comprising a rectangular frame or support member 31. Rectangular frame or support member 31 is supported along its upper and lower edges by laterally-spaced pairs of pivotal link arms and 33, 33*a* (only upper link arms illustrated in drawings) which, at their outer ends are pivotally journaled with respect to the top and bottom members, respectively, of the picture frame housing 12. This pivotal linkage is such as comprises a parallel guide mechanism constraining outward movement of the third panel carrier 18 to parallel relative disposition with respect to said picture frame housing. Thus, as illustrated in FIGS. 4 and 8, when the second interior panel carrier 16 is unfolded to the left, the continuous third display panel 17, through its flexible central portion 17*b*, serves to pull the third panel carrier 18 outwardly of the picture frame housing 12 from the position as illustrated in FIG. 7 to the position illustrated in FIG. 8, whereat its front surface will be brought into approximately the same plane as that occupied by the now unfolded second interior panel carrier 16. It is further to be noted when the first and second interior panel carriers 14 and 16 are thereafter collapsed or folded again into the picture framing housing 12, as illustrated in FIG. 6, the pivotal linkages including the above-described parallel guide mechanism for the third panel carrier 18 enable the three interior panel carriers to be compactly received in face-to-face, substantially abutting relation within the interior confines of the picture frame housing 12 so that, as described-above, the front panel can be folded flat against the front edges of the housing 12.

It is to be noted that, as illustrated in the drawings, although the top and the bottom hinge links 23 supporting the front panel 11 are somewhat visible, they could be fully concealed in their pivotal attachment to the front panel by having their outer ends pivoted within recesses provided within the back surface portions of the front panel framework. With such construction the folding picture frame, when folded together, would present the appearance of an ordinary picture frame carrying a picture or mirror, for example, simply for decorative use in the home or office. An important advantage of the invention resides not only in this feature, but also in that, although occupying only a small or limited wall space, when unfolded it serves to display various selected charts, maps, or the like of approximately double size. As such, the picture frame comprising the invention can be hung attractively and inconspicuously in small rooms or against small wall areas with the advantage of comparatively large display of the contained pictures, maps, charts or the like without the requirement of correspondingly large wall hanging space. Thus, it will be understood that the unfolding portions of the picture frame housing, being supported by the housing, can be swung outwardly into open space, such as along the front of a doorway opening, during temporary display of the contained pictures, charts, maps, or the like.

While I have illustrated and described herein only one form in which the invention may conveniently be embodied in practice, this embodiment is presented by way of example only, and not in a limiting sense. The invention, in brief, comprises all the embodiments and modifications coming within the scope and spirit of the following claims.

What I claim as new and desire to secure by Letters Patent is:

1. A folding picture frame comprising, in combination, a rectangular housing, a rectangular front picture panel, means hinging said front picture panel at one side along one side of said housing for swinging said front picture panel between face-to-face overlying and sidewardly outwardly-extending positions with respect to the front surface of said rectangular housing, said front picture panel, when swung to said sidewardly outwardly-extending position, revealing a first interior picture of approximately twice the size of said front panel picture, said first interior picture comprising a first section fixed against the inner surface of said front picture panel, a first carrier member normally within said housing, said first interior picture further comprising a second section supported in front of said first carrier, and said first interior picture further comprising a flexible central first interior picture section interjoining said first and second picture sections, said front picture panel hinging means, upon said front picture panel being swung to said outwardly-extending position, being operative to position the inner surface of said front picture panel to lie in substantially the same plane as that of the front surface of said housing, said first carrier member being so disposed within said housing as to display said first interior picture sections in a substantially common plane.

2. A folding picture frame as defined in claim 1 and further comprising hinge means supporting said first carrier member for swinging movement between its position within said housing and a sidewardly-outwardly-extending position in face-to-face relation against the inside of said front picture panel when in its sidewardly-outwardly-extending position, a second interior picture comprising a first section fixed against the inner surface of said first carrier member, a second carrier member normally within said housing, said second interior picture further comprising a second section supported in front of said first carrier member, said second interior picture further comprising a flexible second interior picture section interjoining said first and second picture sections of said second interior picture, hinge means supporting said second carrier member within said housing, said first carrier member hinge means together with said second carrier hinge means being cooperative to display said second interior picture in a common plane upon said first carrier member being moved to said sidewardly-outwardly-extending position.

3. A folding picture frame as defined in claim 2 wherein said hinge means supporting said second carrier member is further operative to permit swinging movement between its position within said housing and a sidewardly outwardly-extending position in face-to-face relation against the inside of said first carrier member when in its sidewardly outwardly-extending position, a third interior picture comprising a first section fixed against the inner surface of said second carrier member, a third carrier member normally within said housing, said third interior picture further comprising a second portion supported in front of said second carrier member, said third interior picture further comprising a flexible third interior picture section interjoining said first and second picture sections of said third interior picture, means supporting said third carrier member within said housing and comprising parallel guide mechanism operative to permit movement of said third carrier member from within said housing to a position forward thereof but in relatively parallel disposition, said flexible third interior picture section being operative, when said second carrier member is moved to its sidewardly outwardly-extending position, to pull said third carrier member outwardly of said picture housing so that said third interior picture sections will lie in a substantially common plane.

* * * * *